US010405618B1

(12) United States Patent
Gavin

(10) Patent No.: US 10,405,618 B1
(45) Date of Patent: Sep. 10, 2019

(54) MAXIMUM LIGHT PERFORMANCE GEMSTONE CUTTING TECHNIQUE

(71) Applicant: Brian Steven Gavin, Houston, TX (US)

(72) Inventor: Brian Steven Gavin, Houston, TX (US)

( * ) Notice: Subject to any disclaimer, the term of this patent is extended or adjusted under 35 U.S.C. 154(b) by 182 days.

(21) Appl. No.: 15/717,472

(22) Filed: Sep. 27, 2017

Related U.S. Application Data

(60) Provisional application No. 62/400,516, filed on Sep. 27, 2016.

(51) Int. Cl.
*B28D 5/00* (2006.01)
*A44C 17/00* (2006.01)

(52) U.S. Cl.
CPC ..... *A44C 17/001* (2013.01)

(58) Field of Classification Search
CPC ..... B28D 5/00; A44C 17/001
USPC ..... 125/30.01
See application file for complete search history.

(56) References Cited

U.S. PATENT DOCUMENTS 3,585,764 A * 6/1971 Huisman ..... A44C 17/001 451/58
4,083,352 A * 4/1978 Andrychuk ..... A44C 17/001 125/30.01
5,072,549 A * 12/1991 Johnston ..... A44C 17/001 451/389
5,297,362 A * 3/1994 Wykoff ..... B24B 9/167 451/279
5,462,474 A * 10/1995 Hansen ..... A44C 17/001 125/30.01
6,397,832 B1 * 6/2002 Shuto ..... A44C 17/001 125/30.01
6,474,102 B1 * 11/2002 Buerger ..... A44C 17/001 63/32
7,225,641 B2 * 6/2007 Kawabuchi ..... A44C 17/001 63/32
7,228,856 B2 * 6/2007 Aoyagi ..... A44C 17/001 125/30.01
7,336,347 B2 2/2008 Sasian et al.
7,355,683 B2 * 4/2008 Sasian ..... G01N 21/87 356/30
7,382,445 B2 6/2008 Sasian et al.
7,420,657 B2 9/2008 Sasian et al.
(Continued)

OTHER PUBLICATIONS

Yantzer, Peter et al., "Foundation, Research Results and Application of the New AGS Cut Grading System", American Gem Society (2005) published at [[https://www.]]americangemsociety.org/Content/uploads/85441435072031.pdf.
AGS Round Brilliant Guidelines, 4mm, 2005, downloaded at [[https://www.]]americangemsociety.org/general/custom.asp?page=roundguidelines&DGPCrSrt=&DGPCrPg=1.
AGSL Proportion Charts, Standard Round Brilliant (2008), downloaded at [[http://]]agslab.com/docs/pbcg/AGSLProportionCharts.pdf, available at [[https://]]web.archive.org/web/20150920030307/http://agslab.com/docs/pbcg/AGSLProportionCharts.pdf.
(Continued)

*Primary Examiner* — George B Nguyen
(74) *Attorney, Agent, or Firm* — Daniel N. Lundeen; Lundeen & Lundeen PLLC

(57) ABSTRACT

A precision hearts and arrows gemstone cut having an AGS light performance grade of ideal 0 and having an ASET image free or essentially free of green hemisphere light in the peripheral regions of the table facet; and methods for shaping the gemstone to eliminate the green table effect. The green table effect is avoided by using specific ranges of crown mains angles, pavilion mains angles, lower halves lengths, and/or lower halves angles, in accordance with specific values and/or mathematical formulae.

20 Claims, 7 Drawing Sheets
(7 of 7 Drawing Sheet(s) Filed in Color)

(56) References Cited

U.S. PATENT DOCUMENTS

| | | | | |
|---|---|---|---|---|
| 8,098,369 | B2 | 1/2012 | Sasian et al. | |
| 8,215,127 | B2 * | 7/2012 | Matsumura | A44C 17/001 63/32 |
| 8,626,601 | B2 | 1/2014 | Klein | |
| 2002/0088450 | A1 * | 7/2002 | Shuto | A44C 17/001 125/30.01 |
| 2003/0181147 | A1 * | 9/2003 | Schachter | A44C 17/001 451/41 |
| 2011/0146350 | A1 * | 6/2011 | Vets | A44C 17/001 63/32 |
| 2013/0319045 | A1 * | 12/2013 | Ritchie | A44C 17/001 63/32 |
| 2015/0173469 | A1 * | 6/2015 | Hasenfeld | A44C 17/001 63/32 |

OTHER PUBLICATIONS

AGS Round Brilliant Guidelines, 6mm, 2005, downloaded at [[https://www.]]americangemsociety.org/general/custom.asp?page=roundguidelines&DGPCrSrt=&DGPCrPg=1.

AGS Round Brilliant Guidelines, 8mm, 2005, downloaded at [[https://www.]]americangemsociety.org/general/custom.asp?page=roundguidelines&DGPCrSrt=&DGPCrPg=1.

AGS Round Brilliant Guidelines, 10mm, 2005, downloaded at [[https://www.]]americangemsociety.org/general/custom.asp?page=roundguidelines&DGPCrSrt=&DGPCrPg=1.

AGS Round Brilliant Guidelines, 12mm, 2005, downloaded at [[https://www.]]americangemsociety.org/general/custom.asp?page=roundguidelines&DGPCrSrt=&DGPCrPg=1.

U.S. Appl. No. 15/662,843 office action dated Dec. 21, 2018.

* cited by examiner

Lower Halves Length = 75.00%

Lower Halves Angle = 42.21°

Lower Halves Length = 76.00%

Lower Halves Angle = 42.18°

Lower Halves Length = 77.00%; Lower Halves Angle = 42.14°

Lower Halves Length = 78.00%

Lower Halves Angle = 42.11°

Lower Halves Length = 79.00%

Lower Halves Angle = 42.07°

Lower Halves Length = 80.00%

Lower Halves Angle = 42.04°

MAXIMUM LIGHT PERFORMANCE GEMSTONE CUTTING TECHNIQUE

CROSS REFERENCE TO RELATED APPLICATION

This application is a non-provisional of and claims the benefit of priority to my application U.S. Ser. No. 62/400,516, filed Sep. 27, 2016, which is hereby incorporated herein by reference.

FIELD OF THE INVENTION

This application is directed to symmetrical gemstone cuts for maximum light performance.

BACKGROUND

In the early twentieth century, Marcel Tolkowsky calculated his measurements for the ideal cut parameters in brilliant cut diamonds as a pavilion mains angle of 40.75°, a crown angle of 34.5°, and a 53% table, with a lower halves angle about 2 degrees steeper than the pavilion mains. In discussion of gemstone cuts, facet angles and dimensions are generally taken with respect to a table angle of 0° and the average diameter of the gemstone measured at the girdle ("diameter" or "width"). The proportions of round cut diamonds commonly preferred by twentieth century precision diamond cutters for super ideal cut diamonds are as follows:

TABLE A

| Typical Round Brilliant Proportions for Ideal Cuts | |
|---|---|
| Table width (size): | 54-57% |
| Crown angle: | 34-35° |
| Pavilion angle: | 40.6-41° |
| Total depth: | 60-62.5% |
| Girdle thickness: | Thin to medium |
| Culet: | None (pointed pavilion) |

These numbers remained fairly constant, within ranges, until around 2004, when the American Gem Society Laboratories ("AGSL") developed the angular spectrum evaluation tool (ASET®) imaging disclosed in U.S. Pat. No. 7,355,683, hereby incorporated herein by reference, as a way to determine how a gemstone, such as a diamond, for example, is handling and returning light to the observer. ASET imaging can be used to generate light performance maps such as the ASET® maps by illuminating the gemstone with green, low angle light from the sides, in the upper hemisphere up to 45 degrees from the horizontal plane of the table facet, representing low-intensity light from an indirect source; red, medium angle light from above at 45 to 75 degrees from horizontal, representing brightness or the brightest, high-intensity light; and blue, high angle light from above at 75 to 90 degrees, representing areas of obstruction, i.e., light that the diamond cannot take in due to the body of the observer, which is useful in assessing contrast as seen by the observer. ASET maps are also useful to assess light leakage, which may appear as a black or gray area in the ASET maps or white if backlighting is used. Modern precision diamond cutters are fortunate to have a variety of tools at their disposal to plan how to cut a particular diamond from the rough, or re-cut a previously cut diamond, for symmetry and light performance. For example, the AGSL can mathematically calculate the light performance grade for a virtual diamond with a given set of proportions, e.g., the diamond cutter can confirm that the proportions proposed for cutting the gemstone should obtain a light performance grade of ideal 0, i.e., no deductions. As used herein, cut and light performance grades are determined according to the standards of the American Gem Society ("AGS") and/or AGSL as of the filing date of this application. In the event of any conflict the AGS shall control. Using ASET imaging, as well as ray tracing and virtual diamond modeling software, the AGSL has determined the combinations over a range of table percentages, crown angles, and pavilion angles, that are needed to obtain ideal cut proportions for maximum light return or brilliance. The procedure is described in Yantzer, Peter et al., "Foundation, Research Results and Application of the New AGS Cut Grading System", American Gem Society (2005), published at [[https://www.]] http://c.ymcdn.com/sites/www.americangemsociety.org/resource/resmgr/docs/AGSLab/AGS-Cut-System.pdf. The AGSL has made available cutting chart guidelines for a standard round brilliant cut at [http://www.] americangemsociety.org/page/roundguidelines, and the AGSL Proportion Charts (2008), published at [[https://www.]] agslab.com/docs/pbcg/AGSLProportionCharts.pdf. These charts are based on an 80% lower halves length, and do not take the angles of the lower halves into account, reflecting the general assumption in the industry that the lower halves are not at all a factor in maximizing light performance. In using these charts, however, the process for planning and executing the cutting of a diamond takes the final weight of the gemstone into account as a primary target, and thus the diamantaire seeking a high light performance may frequently select the steepest angles and largest depths possible at the margins of the values indicated in the charts.

Despite all of these modern tools, applicant has discovered the presence of low-intensity green hemisphere light is often seen in the peripheral areas of tables of diamonds cut using the AGSL charts, even with the crown and pavilion angles otherwise predicting or providing a light performance grade of ideal 0. This green in the peripheral table detracts from the achievement of maximum light performance as seen in the ASET maps. This peripheral green seen in the table periphery by ASET imaging is referred to herein as the "green table effect" or "green in the table."

Table 1 has the proportions of virtual diamonds 1A and 1B discussed in Example 1 below. FIG. 1 illustrates a typical ASET image 10 for a round brilliant cut (non-inventive) diamond 1A having an AGS light performance grade of ideal 0 exhibiting the green table effect, contrasted with a similar cut for an inventive diamond cut according to an embodiment of the present disclosure shown in FIG. 2, and discussed in more detail below. The red regions 12A, 12B indicate light reflection or return from the red hemisphere, which are the brightest areas of the diamond, and most desirable. The green regions 14A, 14B indicate low level light return from the green hemisphere, and are less desirable. The green region 14A in the periphery of the table is the green table effect. The blue regions 16A, 16B indicate a contrast pattern of dark reflections indicative of the symmetry of the cut. The blue regions 16A, 16B form a familiar pattern of arrows seen in certain precision gemstone cuts with a high degree of symmetry—the corresponding image of the crown is a hearts pattern, both of which can be seen in a hearts and arrows viewer instrument. The black regions 18, which may also appear white on some ASET images with backlighting, represent areas of light loss, which are the most undesirable.

One exception to the red-green distinction noted above is that the center region or table reflection of the table facet may sometimes display green light or red light in the ASET image, depending on the angle of the pavilion mains. Above a pavilion mains angle of 40.768° with respect to the table plane, the table reflection is normally red; and below 40.768°, normally green. The appearance of green or red in the central table reflection does not appear to adversely impact the light performance grade of the gemstone. The green table effect as discussed herein does not concern the central table reflection.

The industry appears to be unaware of the green table effect, and at a loss to understand when the green table effect will occur, or how to avoid the green table effect, to obtain super maximum light performance and an ASET map without the peripheral green in the table. Diamantaires are thus in need of ways both to avoid the occurrence of this green table effect in a gemstone with an otherwise expected ideal cut and AGS light performance grade of ideal 0, and if seen in a cut stone, to polish or re-shape the stone to eliminate the green table effect.

SUMMARY OF THE INVENTION

The present invention is directed to the discovery of a green table effect; to gemstone cuts avoiding the green table effect; and to methods of precision shaping (cutting) or re-shaping (re cutting) of gemstones to avoid the green table effect. As used herein, shaping or re-shaping, also called cutting or re-cutting, respectively, refers to the method of altering the proportions and/or angles of a gemstone, including cleaving, bruting, polishing, blocking, brillianteering, and so on.

Applicant has discovered quite unexpectedly that the green table effect is a result primarily of the length, angle, and indexing of the lower halves, and the angle of the pavilion mains, and in some limited instances also the angle of the crown mains Applicant has also discovered that the green table effect can be avoided by targeting, e.g., in the cutting, planning and/or execution process, specific combinations of angles and indexing of the lower halves, as well as pavilion mains angles, lower halves lengths, and the crown mains angles; and/or if present in a gemstone, depending on the deviation of the stone proportions and angles from these targets, that the green table effect can be eliminated in some embodiments by changing, e.g., polishing, one or more or all of the lower halves (angle, length and/or indexing), the pavilion mains (angle), and the crown mains (angle), e.g., just the lower halves only, just the pavilion mains only, just the crown mains only, a combination of the lower halves and the pavilion mains only, a combination of the crown mains and lower halves only, a combination of the crown mains and pavilion mains only, or a combination of the lower halves, the pavilion mains, and the crown mains.

According to some embodiments of the present invention, a method to shape an original gemstone to avoid a green table effect, comprises amending one or more parameters of the gemstone, selected from a lower halves angle, a lower halves length, a pavilion mains angle, and a crown mains angle, in an amount effective to eliminate the green table effect from the amended gemstone. In some embodiments, the amended gemstone has the cut parameters listed in Tables 1 and/or 5 shown in the drawings.

BRIEF DESCRIPTION OF THE DRAWINGS

The attached drawings herein include the following figures.

DETAILED DESCRIPTION

Figure 1:
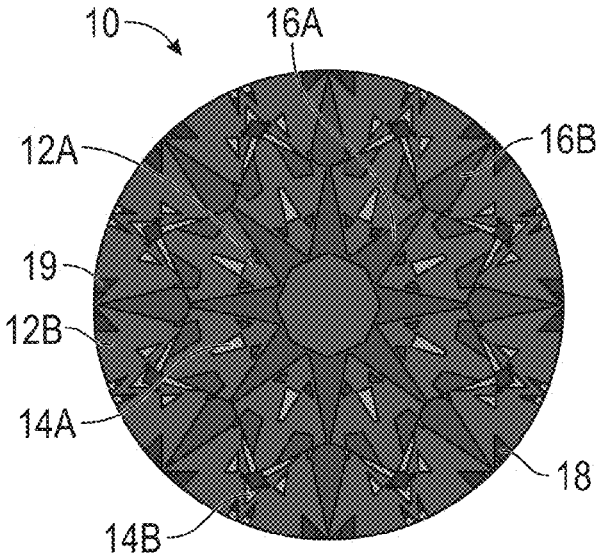
FIG. 1 is an ASET image for a comparative diamond cut for an AGS light performance grade of ideal and exhibiting a moderate green table effect as disclosed herein in Table 1 and Example 1 below.

In the following description and claims, the gemstone components, angles, lengths, widths, thicknesses, etc., are determined in accordance with the American Gem Society (AGS) or American Gem Society Laboratories (AGSL)

definitions and standards, including grading standards for light performance and components thereof, in effect on the filing date of this application. In the case of a conflict between the standards, the AGS definition shall control.

As used herein, "hearts and arrows" are observed using a conventional hearts and arrows scope or viewer. The hearts and arrows images are "complete" when graded as "True Hearts" according to Gavin, Brian, "Hearts and Arrows—How They Are Formed and How They Are Graded," *Proceedings of the First International Diamond Cut Conference* (April 2004).

As used herein, all numbers and values have a range of accuracy that is plus or minus one-half of the significant digit provided, unless otherwise indicated. Numbers and values indicated as "about" have a range of accuracy that is plus or minus one in the significant digits place. For example, an angle given as 41.00 degrees is ±0.005 degrees, whereas an angle given as "about 41.00" is ±0.01.

Table 1 lists the proportions of virtual diamonds 1A and 1B discussed in Example 1 below. According to some embodiments, the present invention provides a gemstone cut having the cut proportions listed in the "operable range" column of Table 1, and optionally one or more, or all, of the cut parameters selected from the "preferred range" column. If no operable range is given in Table 1, the range is not restricted. Two or more different preferred ranges may be given as alternatives in Table 1.

The present invention also provides a method to shape an original gemstone to avoid a green table effect, e.g., by cutting from rough or re-cutting a previously cut gemstone. The method comprises amending one or more parameters of the gemstone selected from a lower halves angle, a lower halves length, a pavilion mains angle, and a crown mains angle, in an amount effective to eliminate the green table effect from the amended gemstone.

In some embodiments, the amendment comprises: (a) if needed, amending the crown mains angle to within 33.7-35.0 degrees, preferably 33.70-35.00 degrees; (b) if needed, amending the pavilion mains angle to within 40.60-41.00 degrees; (c) if needed, amending the lower halves length to within 75-79 percent; and (d) amending one or more of the pavilion mains angle, the lower halves length, and the lower halves angle, such that the lower halves angle is less than a maximum allowable angle according to the data presented in Tables 2 and/or 5, e.g., according to the formulae:

$$PM < LH^\circ \leq LH^\circ_{max} \quad (1)$$

$$LH^\circ_{max} = PM + 1.50 \quad (2)$$

or according to the formula:

$$LH^\circ_{max} = [PM + 1.50 - 0.3667 * (LH\ \% - 75)] \quad (2A)$$

or according to the formula:

$$LH^\circ_{max} = [PM + 1.50 - 0.06 * (PM - 40.5)] \quad (2B)$$

wherein LH° is the lower halves angle in degrees, PM is the pavilion mains angle in degrees, and LH % is the lower halves length in percent of the pavilion mains length.

In Equation (2), the maximum LH° is taken as the highest difference between the pavilion mains angle and the maximum lower halves angle regardless of indexing. Equation (2A) is an example of an approximating interpolative function taking the trends of the lower halves length into account, regardless of indexing. Equation 2(B) is another example of an approximating interpolative function taking the trends of the pavilion mains angle into account, regardless of indexing. As another example taking the trend of the pavilion mains angle into account (especially with indexing and a pavilion mains angle less than 40.9), the maximum LH° can be calculated according to Equation (2A) as follows:

$$LH^\circ_{max} = [PM + 1.38 - 0.06 * (PM - 40.5)] \quad (3)$$

Equation (3) is another example of an interpolative function at or above a pavilion mains angle of 40.9 and/or without indexing, as follows:

$$LH^\circ_{max} = [PM + 1.26 - 0.3667 * (LH\ \% - 75)] \quad (4)$$

In another embodiment, the lower halves angle is preferably no more than 0.3 degrees less than the maximum lower halves angle, according to Equation (5), and/or at least 0.3 degrees more than the pavilion mains angle, according to Equation (5A):

$$LH^\circ_{max} - 0.3 < LH^\circ \leq LH^\circ_{max} \quad (5)$$

$$PM + 0.3 < LH^\circ \leq LH^\circ_{max} \quad (5A)$$

Table 5 is a list of the steepest operable and preferred lower halves angles according to some embodiments of the present invention. With indexing, from the data in Table 5, it is seen that the maximum lower halves angle can be increased relative to the case with no indexing, depending on the amount of indexing. For less than maximum indexing, one can interpolate the maximum allowable lower halves angle between the case of no indexing and maximum indexing for a given pavilion mains angle and lower halves length. The maximum allowable azimuthal shift is given in Table 5, and one can interpolate between the lower halves length and/or the pavilion mains angle. Alternatively, a best fit line or curve based on the data in Table 5, allows one to estimate the maximum allowable azimuthal shift ($LHS_{max}$) where the pavilion mains angle is less than 40.9 according to the following formula (6):

$$LHS_{max} \leq [1.37 - 3.43 * (PM - 40.5) - 0.8393 * (PM - 40.5)^2 + 0.07 (LH\ \% - 75)] \quad (6)$$

where PM and LH % are as defined above.

In some embodiments, the amendment comprises measuring the original gemstone and cutting or polishing the gemstone as needed to obtain the desired amended crown mains angle, pavilion mains angle, lower halves length, and lower halves angle.

In some embodiments, the method comprises determining the polishing needed to obtain the desired amended crown mains angle, pavilion mains angle, lower halves length, and lower halves angle, and polishing the gemstone according to the determined polishing.

In some embodiments, the method comprises determining cuts needed to obtain or approximate desired amended crown mains angle, pavilion mains angle, lower halves length, and lower halves angle, and cutting the gemstone according to the determined cuts.

In some embodiments, the method comprises determining the polishing needed to obtain the desired amended crown mains angle, pavilion mains angle, lower halves length, and lower halves angle, and polishing the gemstone according to the determined polishing.

In some embodiments, the method comprises, prior to the cutting or polishing, simulating the amended gemstone to determine the presence or absence of the green table effect in the simulation.

In some embodiments, the shaping comprises cutting or polishing the lower halves to amend the length or angle of the lower halves. In some embodiments, the shaping consists essentially of polishing the lower halves, e.g., where re-cutting is not required and the green table effect can be eliminated by polishing the lower halves, but the diamond may be cut or polished on other facets for other reasons unrelated to the green table effect.

In some embodiments, the shaping comprises cutting or polishing the pavilion mains to amend the angle of the pavilion mains. In some embodiments, the shaping consists essentially of polishing the pavilion mains, e.g., where re-cutting is not required and the green table effect can be eliminated by polishing the pavilion mains, but the diamond may be cut or polished on other facets for other reasons unrelated to the green table effect.

In some embodiments, the shaping comprises cutting or polishing the pavilion mains and lower halves to amend the angle of the pavilion main, and the angle and length of the lower halves. In some embodiments, the shaping consists essentially of polishing the pavilion mains and lower halves, e.g., where re-cutting is not required and the green table effect can be eliminated by polishing the pavilion mains and lower halves to amend the angle of the pavilion main, and the angle and length of the lower halves, but the diamond may be cut or polished on other facets for other reasons unrelated to the green table effect.

In some embodiments, the shaping comprises cutting the gemstone from rough. In other embodiments, the shaping comprises re-cutting and/or polishing the gemstone from the original cut.

In some embodiments, the amended gemstone comprises: a table of about 53.5 to about 58.0 percent; a crown stars length from about 48 to about 55 percent; a girdle thickness from a minimum of about 0.1 to a maximum of about 5.4 percent; a pavilion mains height from about 43.76 to about 44.23 percent; a crown mains height from about 14.83 to about 16.93 percent; a depth from about 60.0 to about 62.0 percent; complete hearts and arrows image patterns; and an AGS light performance grade of ideal 0.

In some embodiments, the amended gemstone preferably comprises a crown mains angle from 33.7 to 34.8, or to 34.7, or to 34.6, or to 34.5, or to 34.4, or to 34.3 degrees. For example, where the pavilion mains angle is 41.0 degrees, the crown mains angle is preferably 34.3 degrees or less, and where the pavilion mains angle is 40.8 degrees, the crown mains angle is preferably 34.8 degrees or less. Table 2 is a chart of the diamond cut proportions to super maximize light return and performance according to an embodiment of the present invention. At or below a pavilion mains angle of about 40.8, the crown mains angle, within the parameters given in Table 2, does not appear to have any effect on the green in the table.

In some embodiments, the amended gemstone comprises a pavilion mains angle from 40.6 to 40.8.

In some embodiments, the amended gemstone comprises a lower halves length from 75 to 78 percent.

In some embodiments, the amended gemstone comprises (a) a crown mains angle of 33.7-34.7 degrees, (b) a pavilion mains angle of 40.6-40.8 degrees, (c) a lower halves length of 75-78 percent, and (d) a lower halves angle according to the data and/or formulae presented in Tables 2 and/or 5.

In some embodiments, the invention provides a gemstone cut for maximum light performance, comprising:

a. a crown;

b. a pavilion;

c. a scalloped girdle between the crown and pavilion;

d. a diameter taken as an average measurement at the girdle;

e. facets comprising:

a table having an average width from about 53.5 to about 58.0 percent (±0.05 percent) of the diameter;

a plurality of crown mains formed at an average angle of from about 33.7 to about 35 degrees (±0.05 degrees) with respect to the table;

a plurality of crown stars having an average length from about 48 to about 55 percent of an average length of the crown mains;

a plurality of upper halves;

a girdle thickness from a minimum of about 0.1 to a maximum of about 5.4 percent (±0.05 percent) of the diameter;

a plurality of pavilion mains formed below the girdle at an average angle of from about 40.60 to 41.00 degrees with respect to the table and having an average height from about 43.76 to about 44.23 percent of the diameter; and a plurality of lower halves having an average length from about 74.0 to about 79.0 percent of the pavilion mains and formed at an average angle, LH°ave, with respect to the table steeper than the pavilion mains but equal to or less steep than a maximum average angle, LH° amax, according to the data presented in Tables 2 and/or 5, e.g., according to the following formulae:

$$PM_{ave} \leq LH^{\circ}_{ave} \leq LH^{\circ}_{max} \quad (1)$$

$$LH^{\circ}_{amax} = PM_{ave} + 1.5 \quad (2)$$

where $LH^{\circ}_{ave}$ is the average lower halves angle in degrees, $LH^{\circ}_{amax}$ is the maximum average lower halves angle in degrees, $PM_{ave}$ is the average pavilion mains angle in degrees, and $LH\ \%_{ave}$ is the average length of the lower halves as a percentage of the average pavilion mains (or where the maximum LH°, PM, LH % are in accordance with any of Equations (2A), (2B), (3), (4), (5), (5A) and/or (6);

f. a pointed to medium-size culet;

g. an average crown mains height from about 14.83 to about 16.93 percent of the diameter;

h. a depth from about 60.0 to about 62.0 percent of the diameter;

i. complete hearts and arrows image patterns;

j. an AGS light performance grade of 0; and k. wherein an ASET image of the peripheral region of the table facet displays light consisting of red hemisphere light (more than 45°) and is essentially free of green hemisphere light (less than 45°).

In some embodiments, the average crown mains angle is from about 33.70 to about 34.70 degrees; the average pavilion mains angle is from about 40.60 to about 40.80 degrees; and the average lower halves angle is according to the formulae of Equations (2A), (2B), (3), (4), (5), and/or (5A).

In some embodiments, rays traced through the table, to the lower halves, to the pavilion mains, to the crown mains, and then to virtual table facets, are respectively reflected from a said crown main having the angle of from about 33.70 to about 35.00 degrees, from a said pavilion main having the angle of from 40.60 to 41.00 degrees, and from a said lower half having the length of from about 74.0 to about 79.0 percent and the angle, LH°, less steep than the maximum allowable angle, $LH^{\circ}_{max}$, according to the formulae of Equations (1), (2), (2A), (2B), (3), and/or (4).

In some embodiments, the rays traced through the table, to the lower halves, to the pavilion mains, to the crown mains, and then to virtual table facets, are respectively reflected from a said crown main having the angle of from about 33.70 to about 34.70 degrees, from a said pavilion main having the angle of from 40.60 to 40.80 degrees, and from a said lower half having the length of from about 74.0 to about 78.0 percent and the angle, LH°, less steep than the maximum angle, $LH°_{max}$, according to the data presented above and/or in Tables 2 and/or 5, e.g., according to any of the formulae of Equations (1), (2A), (2B), (3), (4), (5), (5A), and/or (6).

In some embodiments, the invention provides a gemstone cut for maximum light performance comprising:

a. a crown;

b. a pavilion;

c. a scalloped girdle between the crown and pavilion;

d. a width at the girdle;

e. facets comprising:

i. a table having an average width from about 53.5 to about 58.0 percent of the diameter;

ii. a plurality of crown mains formed at an angle of from about 33.70 to about 34.70 degrees (±0.005 degrees) with respect to the table;

iii. a plurality of crown stars having an average length from about 48 to about 55 percent of an average length of the crown mains;

iv. a plurality of upper halves;

v. a plurality of pavilion mains formed below the girdle at an angle of from about 40.60 to about 40.80 degrees with respect to the table and having an average height from about 43.76 to about 44.23 percent of the girdle width; and vi. plurality of lower halves each having a length from 75.0 to 78.0 percent of an average of the pavilion mains;

f. a girdle thickness from a minimum of about 0.5 to a maximum of about 3.9 percent of the diameter;

g. a pointed to medium-size culet;

h. an average crown mains height from about 14.83 to about 16.93 percent of the diameter;

i. a depth from about 60.0 to about 62.0 percent of the girdle width;

j. wherein rays traced through the table, to the lower halves, to the pavilion mains, to the crown mains, and to virtual table facets, respectively reflect from a said crown main having the angle of from about 33.70 to a maximum of about 34.70 degrees, from a said pavilion main having the angle of from 40.60 to 40.80 degrees, and from a said lower half having the length of from about 74.0 to about 78.0 percent and the angle, LH°, less steep than the maximum allowable angle, $LH°_{max}$, according to the data presented above and/or in Tables 2 and/or 5, e.g., according to any of the formulae of Equations (1), (2A), (2B), (3), (4), (5), (5A), and/or (6);

k. complete hearts and arrows image patterns;

l. an AGS light performance grade of 0; and m. wherein a high definition ASET image of the virtual table-lower halves-pavilion mains-crown mains-table facets displays light consisting of the red hemisphere light and is essentially free of green hemisphere light.

The invention is illustrated by the following examples.

EXAMPLES

In the following examples, ASET images and ray tracing diagrams were simulated by the American Gem Society Laboratories ("AGSL").

Example 1

To demonstrate a dramatic instance of the green table effect, the ASET images for similar virtual brilliant cut diamonds were simulated by the AGSL with a 58.0% table width, a 34.5° crown main angle, a 50% star width, the same star angle, and the same angle and azimuth of the upper girdle facets. In virtual diamonds 1A (comparative) and 1B (inventive), the lower girdle length was held constant at 77%, while the angles of the pavilion mains and halves were varied by only 0.05°, from 41.00° and 42.19°, to 40.95° and 42.14°, respectively. The parameters and ASET images are shown in Table 1.

As seen in Table 1, varying the angles of the pavilion mains and halves by only 0.05° resulted in the complete disappearance of moderate green in the peripheral table facet and produced the improvement in light performance according to the present invention.

Example 2

Two series of virtual diamond simulations were run based on the same parameters of Example 1B, except that in Series 2A the lower halves angle was set at 42.14° while the lower halves length ranged from 75% to 80%, and in Series 2B the lower halves length was set at 77% while the lower halves angle ranged from 42.04° to 42.21°. Table 3 lists the proportions of virtual cut diamonds discussed in this Example 2, wherein the Series 2A diamonds have a constant 42.14° lower halves angle with a variable lower halves height from 75 to 80%, and the Series 2B a constant lower halves height of 77% with variable lower halves angle from 42.21° to 42.14°. The parameters and ASET images are indicated in Table 3:

As seen in Table 3, above a threshold lower halves height, somewhere between 77-78% in this case, the green table effect appears, and green is present in the peripheral table region in the ASET image. Similarly, above a threshold lower halves angle, somewhere between 42.14°-42.18° for these parameters, the green table effect appears in the peripheral table region in the ASET image.

Example 3

Next, a ray tracing analysis was done for the diamonds 1A and 1B. Table 4 lists the proportions of virtual cut diamonds discussed in this Example 3. The virtual facet diagrams overlaid on the ASET diagrams are indicated in Table 4.

The sixteen virtual table facets 20 are green in Image 3A, but red in Image 3B. The light paths that create the virtual facets 20, were found to both follow the same path, but due to the angles that the light interacts with, it results in incident light from different locations in the hemisphere. Ray tracing the virtual diamonds of Series 1A and 1B produced similar corresponding results. These results indicated that for steeper pavilion mains greater than about 40.8 to 41 degrees, a shallower crown mains angle (less than 35 degrees) and/or shallower lower halves angle would eliminate the green from the facets 20. Also observed was that, as the lower halves become longer and/or the pavilion mains become shallower, the lower halves should also be more shallow to eliminate the green light from the facets 20.

Based on these observations, additional simulations were conducted to determine the approximate upper limit of the lower halves angle based on the proportions of the pavilion mains angle and the lower halves length, needed for ensuring green would not appear in the virtual table facets 20. The results are tabulated in Table 5 as the "preferred" maximum lower halves angle. The "operable" maximum lower halves angle in Table was developed by indexing as discussed in Example 10 below.

The preferred highest allowable lower halves angle can be obtained from Table 5. In practice, the preferred values in Table 5 can be interpolated, yielding the following equation for the approximate proportions of the lower halves angles that will avoid the green table effect without indexing:

$$PM<LH^\circ \leq LH^\circ_{max} \quad (1)$$

$$LH^\circ_{max}=[PM+1.26-0.3667*(LH\ \%-75)] \quad (4)$$

where LH° is the lower halves angle in degrees, $LH^\circ_{max}$ is the maximum lower halves angle in degrees, PM is the pavilion mains angle in degrees, and LH % is the length of the lower halves as a percentage of the pavilion mains. This interpolative equation is shown in Table 2 for the preferred maximum lower halves angle.

Example 4

Two cut diamonds 4A and 4B exhibiting isolated green in only one location of virtual table facets 20, but red in all the others, were selected for analysis. Table 6 lists the proportions of two comparative cut diamongs 4A and 4B having a green table facet as discussed in this Example 4. The proportions of the facets along the rays to the green virtual facets and the ASET images are shown in the figures indicated in Table 6. For stone 4A, with a 76% lower girdle length, according to formula (1) from Example 3, the lower girdle angle needs to be at about 42.00-42.03 or shallower. With the combination of crown main facet and the slightly steeper lower girdle angle, this virtual facet is reflecting light from the green hemisphere. For stone 4B, with a 77% lower girdle length, the lower girdle angle needs to be at about 41.90-41.99 or shallower to avoid reflecting green hemisphere light.

Example 4A

Figure 18:
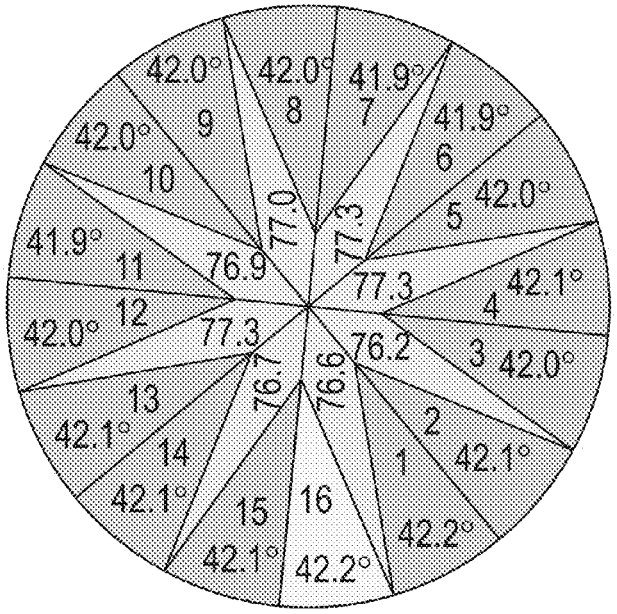
FIG. 18 shows the pavilion diagram of Example 4A with the lower halves angles and percentages labeled.
Figure 19:
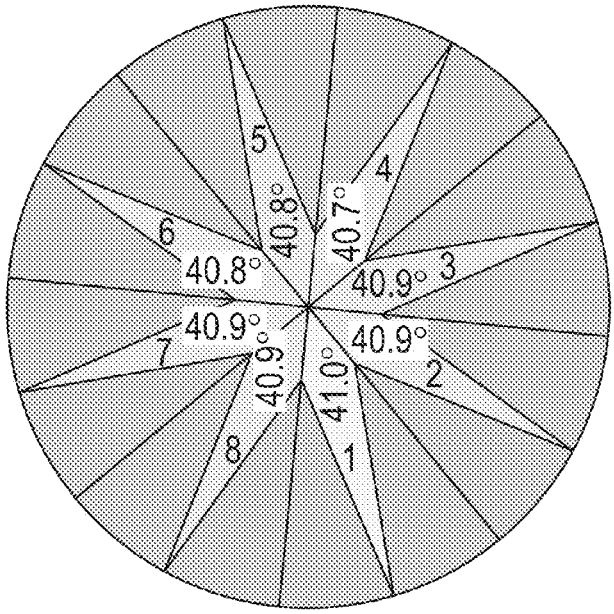
FIG. 19 shows the pavilion diagram of FIG. 18 with the main pavilion facet angles labeled.

This example shows how another previously cut diamond exhibiting a green table effect may be measured and a hypothetical plan developed for polishing and/or cutting the stone to eliminate the green table effect. A cut diamond was measured and the pavilion mapped in FIGS. 18 and 19. The lower halves lengths and angles are shown in FIG. 18; the angles of the pavilion mains in FIG. 19. In this example, lower halves numbered 1 and 16 (FIG. 18) are seen as being steeper (42.2°) and shorter (76.2% and 76.6%) than the others; and at the same time, the pavilion main numbered 5 (FIG. 19), which reflects the corresponding rays in the ray tracing, is relatively shallower (40.8°) than the average in this pavilion. Green table effect from these lower halves and pavilion main can be eliminated by polishing the lower halves 1 and 16 to make them slightly shallower and longer, along with lower halves 2 and 15 as needed to maintain symmetry. At the same time, polishing the pavilion main numbered 1 to be slightly shallower (from 41.0°) should not introduce green in the table since reflecting lower halves 8 and 9 (77.0%/76.9% and both at 42.0°) are not steeper than allowed, as indicated from reading and interpolating Table 5, or from the equations in Table 2.

Example 5

This example explored whether making the lower halves shallower can eliminate a green table effect. A virtual diamond 5 exhibiting the green table effect in an ASET diagram, but very close to eliminating the green table effect, was selected as a control and had the following proportions:

TABLE B

| Proportions of Virtual Diamond 5. | |
|---|---|
| Table: | 56% |
| Crown Main: | 34.9° |
| Upper Halves Angle | 41.60° |
| Pavilion Main: | 40.9° |
| Lower Halves Angle: | 42.09° |
| Lower Halves Height | 77% |
| Star Width | 48% |
| Stars Angle | 21.68° |

Reducing the lower halves angle in increments of 0.08°-0.10° down to 41.11° showed no green table effect. However, the proportions became extreme for maximum light return below a lower halves angle of about 40.79°, indicating that the lower halves angle preferably has a lower limit that is no more than 0.3° below the angle needed to transition away from the green table effect. Increasing the lower halves angle up to 43.74° did not eliminate the green table effect in any of the simulated diamonds.

Example 6

This example explored whether the upper halves angles impacted the green table effect. Diamond 5 of Example 5 was used as a control. Incrementally decreasing the upper halves angle to 36.29°, or increasing to 47.83°, did not eliminate the green table effect.

Example 7

This example explored whether the widths or angles of the stars impacted the green table effect. Diamond 5 of Example 5 was again used as a control. Incrementally decreasing the stars angle to 17.50° and width to 36%, or increasing to 24.5° and 63%, did not eliminate the green table effect.

Example 8

Figure 20:
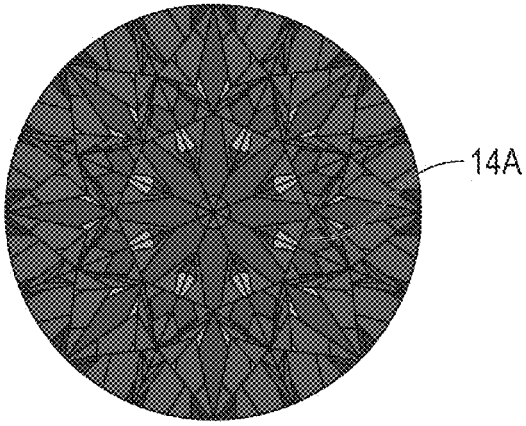
FIG. 20 shows the superimposed ray tracing and ASET diagrams for the 47% table in Example 8.
Figure 21:
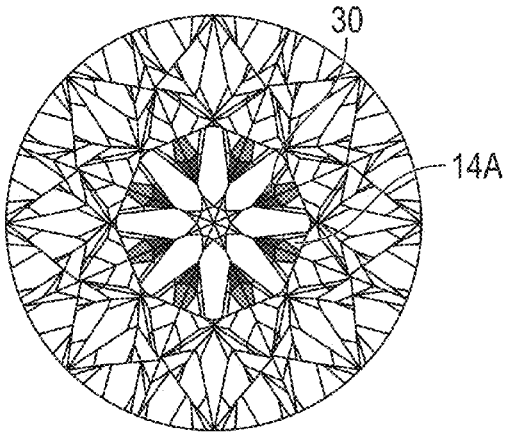
FIG. 21 shows the ray tracing diagram of FIG. 20, but with only the green and adjacent blue table facets from the ASET diagram for clarity.
Figure 22:
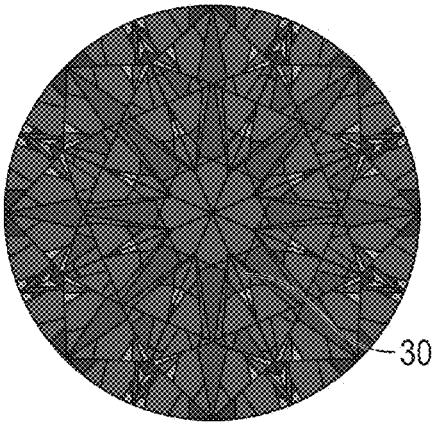
FIG. 22 shows the superimposed ray tracing and ASET diagrams for the 62% table in Example 8.
Figure 23:
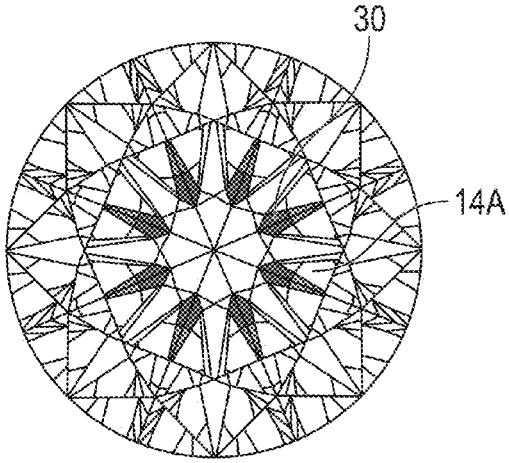
FIG. 23 shows the ray tracing diagram of FIG. 22, but with only the green and adjacent red table facets from the ASET diagram for clarity.

This example explored whether the table size impacted the green table effect. Incrementally decreasing the table to 47%, or increasing to 62%, without changing the table height, did not eliminate the green table effect. However, the size of the green areas in the table facet appeared to decrease as the table was increased. The ray tracing and ASET image diagrams in FIGS. 20-23 indicate that the facets 80 below the respective green table facets 20 increased in size from FIGS. 20 and 21 and "pushed up" the green table facets 20, as seen in FIGS. 22 and 23.

Example 9

This example explored whether the crown mains angle impacted the green table effect. At a pavilion mains angle of 41.00°, incrementally decreasing the crown mains angle to 34.30° resulted in elimination of the green table effect, which disappeared last at halves lengths 75% and 76%. At a pavilion mains angle of 40.95°, a crown mains angle below 34.65° was needed to eliminate the green table effect (at 75% lower halves length); and at 40.9°, below 35.00°. At a pavilion mains angle of below 40.9°, crown angles below 35° had no effect on the appearance of the green table effect, suggesting that within the proportion parameters of this invention (crown mains less than 35.00°), the green table effect was controlled exclusively by the main pavilions angle, lower halves angle and lower halves length. This discovery allows the cutter (or re-cutter) to, in most instances, adjust only the pavilion mains and lower halves to eliminate the green table effect. In some instances, especially where the green table effect can be eliminated by slightly shallowing the pavilion mains and/or lower halves, these amendments can be effected largely by polishing, minimizing the need for cutting.

Example 10

This example explored the impact of the lower halves angle as adjusted by indexing the azimuth of the lower halves at various pavilion mains angle and lower halves length. For each pavilion main angle and lower halves length, the index and lower halves angle were noted where the green table effect began. The value of the lower halves angles where the green table effect began was consistently about 0.12° higher than the value obtained in Example 3 above, and is listed as the "operable" maximum lower halves angle in Table 5. The corresponding interpolative equation is given in Table 2.

The operable highest allowable lower halves angle can be obtained from Table 5. In practice, the operable values in Table 5 can be interpolated, e.g., yielding the following equation for the approximate proportions of the lower halves angles that will eliminate the green table effect:

$$PM < LH° \leq LH°_{max} \quad (1)$$

$$LH°_{max} = PM + 1.26 - 0.3667(LH\% - 75) \quad (4)$$

$$(LH°_{max} - 0.3) < LH° \leq LH°_{max} \quad (5)$$

where LH° is the lower halves angle in degrees, $LH°_{max}$ is the maximum lower halves angle in degrees, PM is the pavilion mains angle in degrees, and LH % is the length of the lower halves as a percentage of the pavilion mains.

Of course, the lower halves angle must be greater than the pavilion mains angle, and preferably is at least 0.5 degrees steeper, or at least 0.8 degrees steeper, or at least 1.0 degrees steeper, relative to the pavilion mains angle.

Although only a few example embodiments have been described in detail above, those skilled in the art will readily appreciate that many modifications are possible in the example embodiments without materially departing from this invention. Accordingly, all such modifications are intended to be included within the scope of this invention as defined in the following claims. It is the express intention of the applicant not to invoke 35 U.S.C. § 112(f) for any limitations of any of the claims herein, except for those in which the claim expressly uses the words 'means for' together with an associated function and without any recitation of structure.

TABLE 1

The Green Table Effect.

Figure 2:
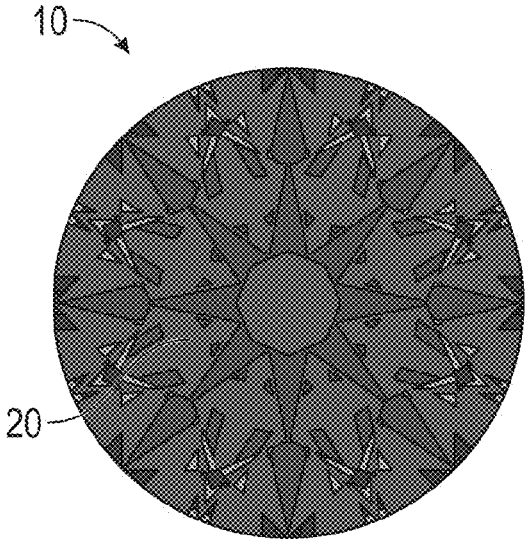
FIG. 2 is an ASET image for a diamond cut according to an embodiment of the present invention for an AGS light performance grade of ideal 0 and exhibiting no green table effect as disclosed herein in Table 1 and Example 1 below.

| Parameter | Virtual Diamond 1A (comparative) | Virtual Diamond 1B (inventive) |
|---|---|---|
| Table Width, % | 58.00 | 58.00 |
| Crown Main Angle, Degrees | 34.50 | 34.50 |
| Star Width, % | 50.00 | 50.00 |
| Pavilion Main Angle, Degrees | 41.00 | 40.95 |
| Lower Halves Length, % | 77.00 | 77.00 |
| Lower Halves Angle, Degrees | 42.19 | 42.14 |
| Green in Table | Moderate | None |
| ASET Image | FIG. 1 | FIG. 2 |

TABLE 2

Diamond Cut Proportions to Super Maximize Light Performance.

| Parameter | Operable Ranges | Preferred Ranges |
|---|---|---|
| Table (%) | 53.5-58.0 | |
| Crown Mains (°) | 33.7-35.0 | 33.70-35.00<br>33.70-34.80:<br>33.70-34.30<br>For PM ≥ 40.8:<br>Equation (6): $CM_{max} = 35.00 - 0.35 * (PM - 40.8)$ |
| Star (%) | 48%-55% | |
| Pavilion Mains (°) | 40.5-41.0 | 40.5-40.9<br>40.5-40.8<br>40.6-40.8 |
| Lower Halves Lengths (%) | 75-79 | 75-78 |
| Lower Halves Angle (°) | Equation (1):<br>$PM < LH° \leq LH°_{max}$<br>Equation (2)<br>$LH°_{max} = PM + 1.5$ | Equation (3)<br>where, for PM < 40.9 (especially with indexing):<br>$LH°_{max} = [PM + 1.26 + 0.06 * (40.9 - PM) - 0.3667 * (LH\% - 75)]$<br>Equation (4)<br>where, for PM ≥ 40.9 and/or no indexing:<br>$LH°_{max} = PM + 1.26 - 0.3667(LH\% - 75)$<br>Equation (5)<br>$(LH°_{max} - 0.3) < LH° \leq LH°_{max}$ |
| Lower Halves Indexing (Azimuthal Shift, °) | | Equation (6):<br>where PM < 40.9:<br>$LHS_{max} \leq [A - B + C]$<br>Where<br>A = 1.37<br>$B = [3.43 * (PM - 40.5) + 0.8393 * (PM - 40.5)^2]$<br>$C = 0.07(LH\% - 75)$ |
| Crown Height (%) | 14.83-16.93 | |

TABLE 2-continued

| Diamond Cut Proportions to Super Maximize Light Performance. | | |
|---|---|---|
| Parameter | Operable Ranges | Preferred Ranges |
| Pavilion Height (%) | 43.76-44.23 | |
| Depth (%) | 60.0-62.00 | |

Notes:
LH° = lower halves angle;
PM = pavilion mains angle;
LH% = lower halves length;
$LH°_{max}$ = maximum allowable lower halves angle;
$LHS_{max}$ = maximum allowable azimuthal shift of lower halves, degrees relative to 11.25°;
A = shift constant;
B = PM function;
C = LH% function.

TABLE 3

Figure 3:
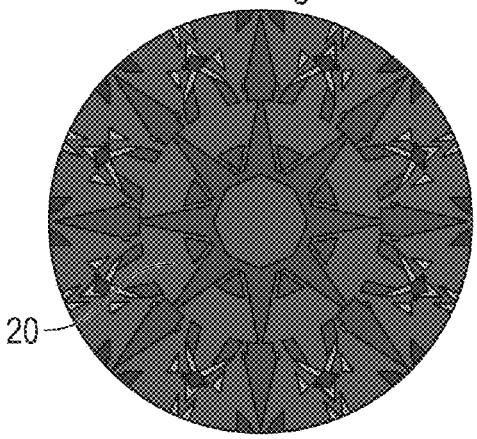
FIG. 3 is an ASET image for the Series 2A diamond listed in Table 3 having lower halves length of 75% according to an embodiment of the present invention.
Figure 4:
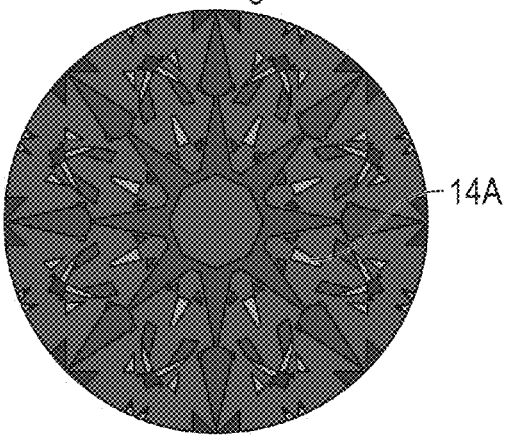
FIG. 4 is an ASET image for the Series 2A diamond listed in Table 3 having a lower halves length of 76% according to an embodiment of the present invention.
Figure 5:
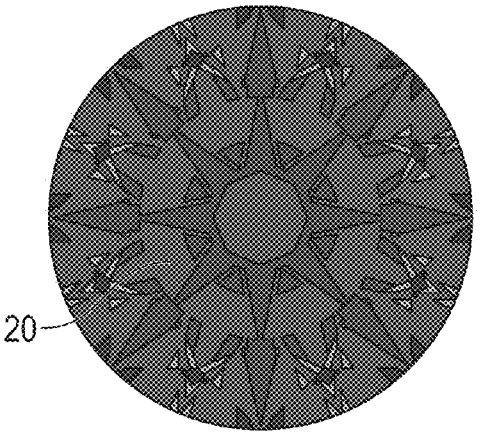
FIG. 5 is an ASET image for the diamond having the same lower halves height (77%) and lower halves angle (42.14°) common to both of the Series 2A and 2B listed in Table 3 according to an embodiment of the present invention.
Figure 6:
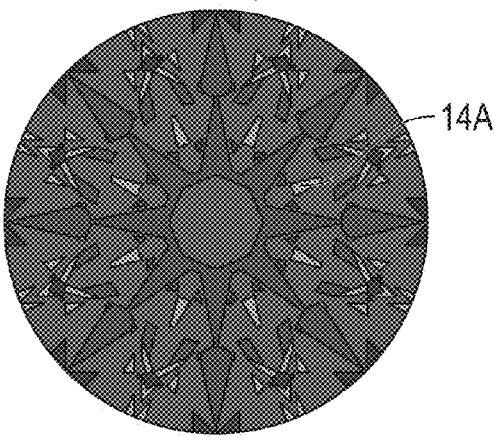
FIG. 6 is an ASET image for the Series 2A diamond listed in Table 3 having a lower halves length of 78%.
Figure 7:
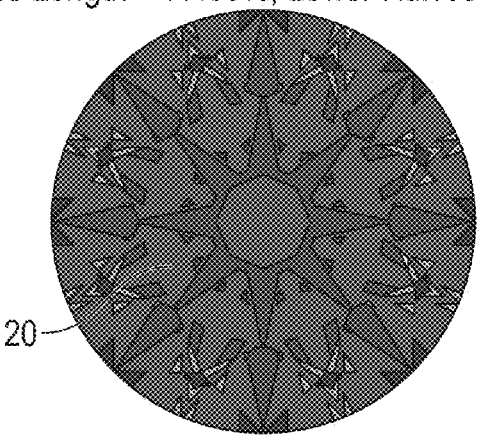
FIG. 7 is an ASET image for the Series 2A diamond listed in Table 3 having a lower halves length of 79%.
Figure 8:
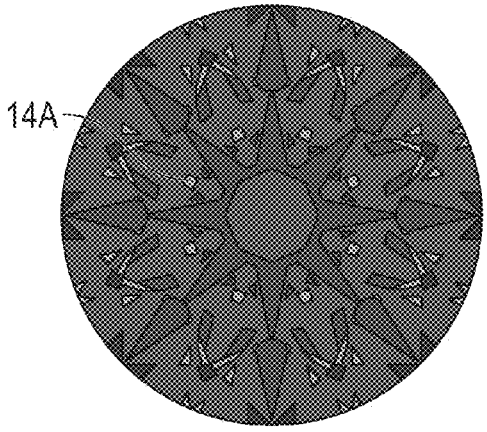
FIG. 8 is an ASET image for the Series 2A diamond listed in Table 3 having a lower halves length of 80%.
Figure 9:
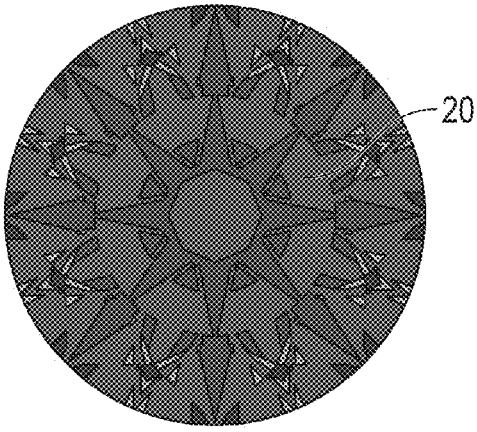
FIG. 9 is an ASET image for the Series 2B diamond listed in Table 3 having a lower halves angle of 42.21°.
Figure 10:
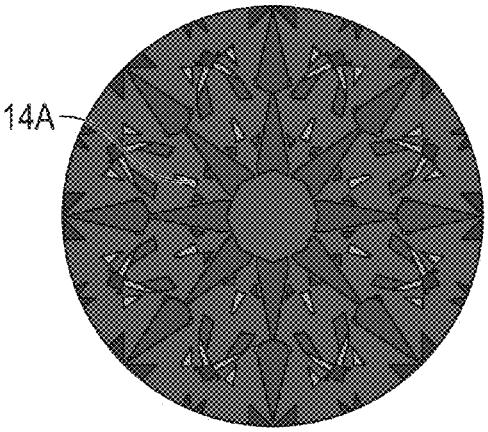
FIG. 10 is an ASET image for the Series 2B diamond listed in Table 3 having a lower halves angle of 42.18°.
Figure 11:
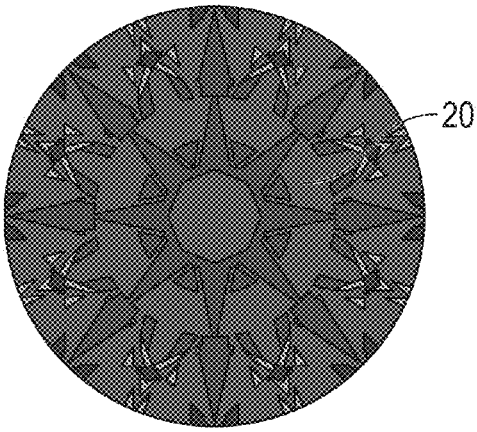
FIG. 11 is an ASET image for the Series 21B diamond listed in Table 3 having a lower halves angle of 42.11° according to an embodiment of the present invention.
Figure 12:
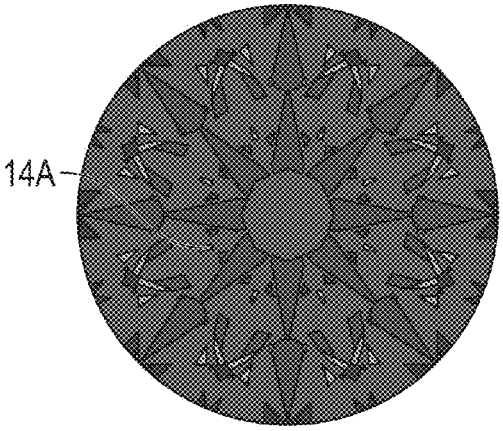
FIG. 12 is an ASET image for the Series 2B diamond listed in Table 3 having a lower halves angle of 42.07° according to an embodiment of the present invention.
Figure 13:
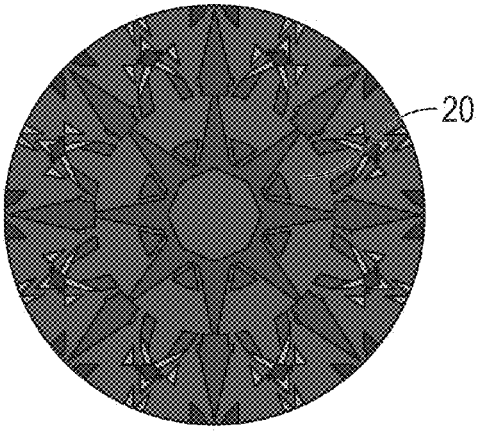
FIG. 13 is an ASET image for the Series 2B diamond listed in Table 3 having a lower halves angle of 42.04° according to an embodiment of the present invention.

| The Green Table Effect from Lower Halves Angle and Length. | | |
|---|---|---|
| | Virtual Diamond Series 2A 42.14° Lower halves Angle | Virtual Diamond Series 2B 77.00% Lower Halves Length |
| Table Width | 58.00% | 58.00% |
| Crown Main Angle | 34.50° | 34.50° |
| Star Width | 50.00% | 50.00% |
| Pavilion Main Angle | 40.95° | 40.95° |
| Lower Halves Length | Variable 75-80% | 77.00% |
| Lower Halves Angle | 42.14° | Variable 42.04°-42.21° |
| | FIG. 3 | FIG. 4 |
| | Lower Halves Length = 75.00% | Lower Halves Angle = 42.21° |
| | FIG. 5 | FIG. 6 |
| | Lower halves Length = 76.00% | Lower halves Angle = 42.18° |
| | FIG. 7 | |
| | Lower halves Length = 77.00%; Lower halves Angle = 42.14° | |
| | FIG. 8 | FIG. 9 |
| | Lower Halves Length = 78.00% | Lower Halves Angle = 42.11° |
| | FIG. 10 | FIG. 11 |
| | Lower Halves Length = 79.00% | Lower Halves Angle = 42.07° |
| | FIG. 12 | FIG. 13 |
| | Lower Halves Length = 80.00% | Lower Halves Angle = 42.04° |

Figure 14:
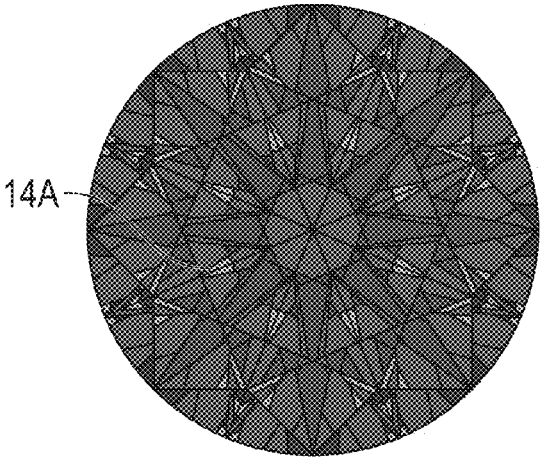
FIG. 14 is a ray tracing diagram overlaid on the ASET image of FIG. 1.
Figure 15:
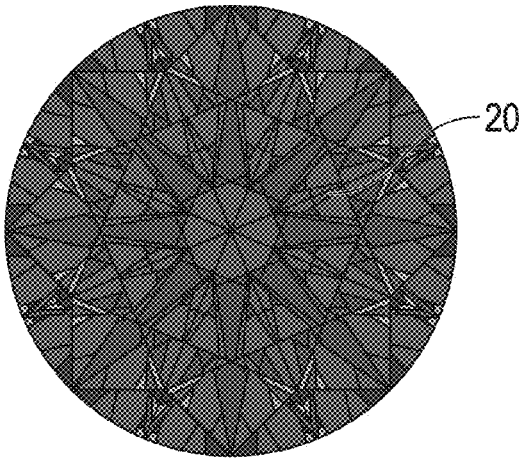
FIG. 15 is a ray tracing diagram overlaid on the ASET image of FIG. 2 according to an embodiment of the present invention.

| Ray Tracing Diagram + ASET. | | |
|---|---|---|
| Parameter | Virtual Diamond 1A (comparative) | Virtual Diamond 1B (inventive) |
| Pavilion Main Angle, Degrees | 41.00 | 40.95 |
| Lower Halves Length, % | 77.00 | 77.00 |
| Lower Halves Angle, Degrees | 42.19 | 42.14 |
| Virtual facet/ray tracing diagram overlaid on ASET diagram | FIG. 14 | FIG. 15 |

TABLE 5

| Lower Halves Angle/Indexing Chart. | | | | |
|---|---|---|---|---|
| Pavilion | Lower | Lower Halves Angles (°) and Indexing (°) | | |
| Mains Angle (°) | Halves Length (%) | Max LH Angle, No Indexing | Permissible LH Azimuthal Shift | Max LH Angle, with Indexing |
| 40.5 | 75 | 41.76 | +1.37 | 42.00 |
| | 76 | 41.72 | +1.44 | 41.97 |

TABLE 5-continued

| Lower Halves Angle/Indexing Chart. | | | | |
|---|---|---|---|---|
| Pavilion | Lower | Lower Halves Angles (°) and Indexing (°) | | |
| Mains Angle (°) | Halves Length (%) | Max LH Angle, No Indexing | Permissible LH Azimuthal Shift | Max LH Angle, with Indexing |
| | 77 | 41.69 | +1.51 | 41.94 |
| | 78 | 41.65 | +1.58 | 41.91 |
| | 79 | 41.62 | +1.64 | 41.88 |
| 40.6 | 75 | 41.86 | +1.03 | 42.04 |
| | 76 | 41.83 | +1.10 | 42.01 |
| | 77 | 41.79 | +1.17 | 41.98 |
| | 78 | 41.75 | +1.24 | 41.95 |
| 40.7 | 75 | 41.96 | +0.67 | 42.08 |
| | 76 | 41.93 | +0.74 | 42.05 |
| | 77 | 41.89 | +0.81 | 42.02 |
| | 78 | 41.85 | +0.88 | 41.99 |
| 40.8 | 75 | 42.06 | +0.29 | 42.11 |
| | 76 | 42.03 | +0.39 | 42.09 |
| | 77 | 41.99 | +0.44 | 42.06 |
| | 78 | 41.96 | +0.51 | 42.04 |
| 40.9 | 75 | 42.16 | | |
| | 76 | 42.13 | | |
| | 77 | 42.09 | | |
| | 78 | 42.06 | | |
| | 79 | 42.02 | | |
| 41.0 | 75 | 42.26 | | |
| | 76 | 42.23 | | |
| | 77 | 42.19 | | |
| | 78 | 42.16 | | |
| | 79 | 42.12 | | |

TABLE 6

Figure 16:
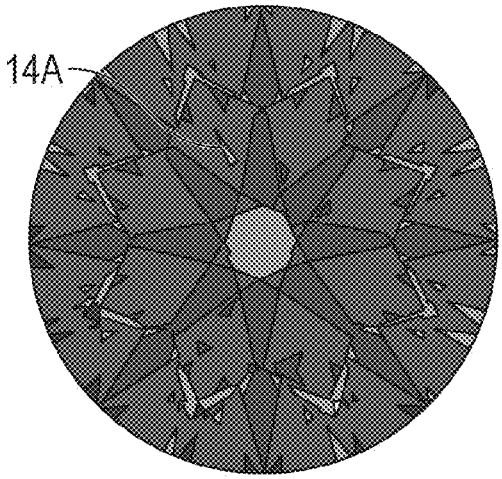
FIG. 16 is an ASET image for diamond 4A listed in Table 6.
Figure 17:
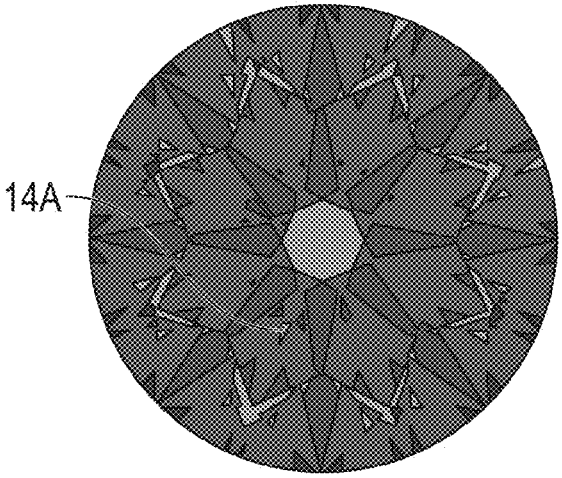
FIG. 17 is an ASET image for diamond 4B listed in Table 6.

| Diamond Showing Green Table Effect in Isolated Virtual Facet. | | |
|---|---|---|
| Parameter | Diamond 4A (comparative) | Diamond 4B (comparative) |
| ASET diagram | FIG. 16 | FIG. 17 |
| Interacting Facet | Facet Angle | |
| Table | 0° | 0° |
| Lower Half | 42.17° | 42.08° |
| Lower Half Length | 76% | 77% |
| Pavilion Main | 40.78° | 40.71° |
| Crown Main | 34.76° | 34.74° |

What I claim is:

1. A method to shape an original gemstone to avoid a green table effect in a round brilliant cut, comprising:

if a crown mains angle is less than 33.70 or more than 35.00 degrees, amending the crown mains angle to within 33.70-35.00 degrees;

if a pavilion mains angle is less than 40.60 or greater than 41.00 degrees, amending the pavilion mains angle to within 40.60-41.00 degrees;

if a lower halves length is less than 75 or more than 79 percent, amending the lower halves length to within 75-79 percent; and amending one or more parameters of the gemstone selected from shallowing a lower halves angle, decreasing the lower halves length, shallowing the pavilion mains angle, and shallowing the crown mains angle, in an amount effective to eliminate the green table effect from the amended gemstone.

2. The method of claim 1, wherein the amendment comprises:

amending one or more of the pavilion mains angle, the lower halves length, and the lower halves angle, such that the lower halves angle is less than a maximum allowable angle according to the formulae:

$$PM<LH^\circ \leq LH^\circ_{max} \quad (1)$$

$$LH^\circ_{max}=[PM+1.38-0.3667*(LH\ \%-75)] \quad (2)$$

wherein LH° is the lower halves angle in degrees, PM is the pavilion mains angle in degrees, and LH % is the lower halves length in percent of the pavilion mains length.

3. The method of claim 2, wherein the amendment comprises measuring the original gemstone and cutting or polishing the gemstone to obtain said amended crown mains angle, pavilion mains angle, lower halves length, and lower halves angle.

4. The method of claim 3, further comprising determining the polishing needed to obtain said amended crown mains angle, pavilion mains angle, lower halves length, and lower halves angle, and polishing the gemstone according to the determined polishing.

5. The method of claim 3, further comprising determining cuts needed to obtain or approximate said amended crown mains angle, pavilion mains angle, lower halves length, and lower halves angle, and cutting the gemstone according to the determined cuts.

6. The method of claim 5, further comprising determining the polishing needed to obtain said amended crown mains angle, pavilion mains angle, lower halves length, and lower halves angle, and polishing the gemstone according to the determined polishing.

7. The method of claim 3, further comprising, prior to the cutting or polishing, simulating the amended gemstone to determine the presence or absence of the green table effect in the simulation.

8. The method of claim 1, wherein the shaping comprises cutting or polishing the lower halves to amend the length or angle of the lower halves.

9. The method of claim 8, wherein the shaping consists essentially of polishing the lower halves.

10. The method of claim 1, wherein the shaping comprises cutting or polishing the pavilion mains to amend the angle of the pavilion mains.

11. The method of claim 10, wherein the shaping consists essentially of polishing the pavilion mains.

12. The method of claim 1, wherein the shaping comprises cutting or polishing the pavilion mains and lower halves to amend the angle of the pavilion main, and the angle and length of the lower halves.

13. The method of claim 12, wherein the shaping consists essentially of polishing the pavilion mains and lower halves.

14. The method of claim 1, wherein the shaping comprises cutting the gemstone from rough.

15. The method of claim 1, wherein the shaping comprises re-cutting the gemstone from the original.

16. The method of claim 1, wherein the amended gemstone comprises: a table of about 53.5 to about 58.0 percent; a crown stars length from about 48 to about 55 percent; a girdle thickness from a minimum of about 0.1 to a maximum of about 5.4 percent; a pavilion mains height from about 43.76 to about 44.23 percent; a crown mains height from about 14.83 to about 16.93 percent; a depth from about 60.0 to about 62.0 percent; complete hearts and arrows image patterns; and an AGS light performance grade of ideal 0.

17. The method of claim 1, wherein the amended gemstone comprises a crown mains angle from 33.70 to 34.70.

18. The method of claim 1, wherein the amended gemstone comprises a pavilion mains angle from 40.60 to 40.80.

19. The method of claim 1, wherein the amended gemstone comprises a lower halves length from 75 to 78 percent.

20. The method of claim 1, wherein the amended gemstone comprises:

a. a crown mains angle of 33.70-34.70 degrees;

b. a pavilion mains angle of 40.60-40.80 degrees;

c. a lower halves length of 75-78 percent; and d. a lower halves angle according to the formulae:

$$(LH^\circ_{max}-0.3)<LH^\circ \leq LH^\circ_{max} \quad (3)$$

$$LH^\circ_{max}=[PM+1.26-0.3667*(LH\ \%-75)] \quad (4)$$

wherein LH° is the lower halves angle in degrees, PM is the pavilion mains angle in degrees, and LH % is the lower halves length in percent of the pavilion mains length.

* * * * *